US006190238B1

(12) United States Patent
Tanaka et al.

(10) Patent No.: US 6,190,238 B1
(45) Date of Patent: Feb. 20, 2001

(54) POLISHING PAD, METHOD AND APPARATUS FOR TREATING POLISHING PAD AND POLISHING METHOD

(75) Inventors: Koichi Tanaka; Koji Morita; Tsutomu Takaku, all of Fukushima-ken (JP)

(73) Assignee: Shin-Etsu Handotai Co., Ltd., Tokyo (JP)

( * ) Notice: Under 35 U.S.C. 154(b), the term of this patent shall be extended for 0 days.

(21) Appl. No.: 09/263,221

(22) Filed: Mar. 5, 1999

(30) Foreign Application Priority Data

Mar. 23, 1998 (JP) ..... 10-074696

(51) Int. Cl.[7] ..... B24B 1/00; B24B 29/00; B24B 5/00

(52) U.S. Cl. ..... 451/41; 451/285; 451/288

(58) Field of Search ..... 451/41, 285, 288, 451/526, 533, 534

(56) References Cited

U.S. PATENT DOCUMENTS

| | | | | |
|---|---|---|---|---|
| 5,257,478 | * | 11/1993 | Hyde et al. | 51/131.3 |
| 5,489,233 | * | 2/1996 | Cook et al. | 451/41 |
| 5,591,239 | * | 1/1997 | Larson et al. | 51/294 |
| 5,690,540 | * | 11/1997 | Elliott et al. | 451/41 |
| 5,882,251 | * | 3/1999 | Berman et al. | 451/527 |

* cited by examiner

*Primary Examiner*—Rodney A. Butler
(74) *Attorney, Agent, or Firm*—Oliff & Berridge, PLC

(57) ABSTRACT

A polishing pad for pressing a work to be polished to a surface thereof, includes a structure obtained by being compressed under a temperature which is higher than an operating temperature for polishing the work and/or under a pressure which is equal or higher than an operating pressure for polishing the work. A method for polishing a includes the step of polishing the work by using the polishing pad.

19 Claims, 4 Drawing Sheets

POLISHING PAD, METHOD AND APPARATUS FOR TREATING POLISHING PAD AND POLISHING METHOD

BACKGROUND OF THE INVENTION

1. Field of the Invention

The present invention relates to a polishing pad, a method and an apparatus for treating a polishing pad, and a polishing method; particularly, to a polishing pad and a polishing method used for polishing a semiconductor wafer (hereinafter, it may be simply referred to as "wafer").

2. Description of Related Art

In a process for fabricating a semiconductor integrated circuit, with the progress of larger scale integration of recent semiconductor devices, the requirement for the flatness of a wafer which is a material for the devices becomes stricter. Therefore, it is required to improve the processing accuracy of a polishing process which influences the flatness of the wafer.

In the polishing process, a wafer which was etched by mixed acid which is mixture of hydrofluoric acid, acetic acid and nitric acid or by an aqueous solution of sodium hydroxide, potassium hydroxide or the like, that is, an etched wafer, is a work to be polished. Because the general flatness of the etched wafer is not enough to meet the requirement and the surface roughness thereof is large, three staged polishing are often carried out in the polishing process. The first polishing step is for mirror polishing the etched wafer by removing the waviness thereof, so that the amount of removal, that is, the entire polishing stock removal is large. The third polishing step is for improving the minute surface roughness of the wafer, so that the entire polishing stock removal is small. The second polishing step which is an intermediate step between the first and the third steps has an intermediate purpose therebetween. Therefore, in each polishing step, a polishing is carried out by changing the polishing condition such as the type of the polishing pad, the type and supplying amount of the polishing slurry, the relative rotation speed between the wafer and the polishing pad, and the contacting pressure of the wafer which is contacted with the polishing pad, that is, the polishing pressure, according to the difference of the purpose of the each polishing step.

Among various types of polishing conditions, the one with respect to the polishing pad has the greatest influence on the flatness of the wafer, especially to the waviness which have a cycle or wavelength of several millimeters and to the ripples which have a cycle or wavelength of scores of microns. That is, the polishing pad has the greatest influence in the first polishing step which gives the largest entire polishing stock removal.

The wafer is polished by a polishing machine, for example, the one which is shown in FIG. 4. That is, a wafer 1 is held to adhere on the lower surface of a holding plate 8 which is attached to a top ring 2 of a polishing head. A rotational motion is given to the wafer 1 by a head driving motor 5, while the wafer 1 is pressed against a polishing pad 9 which is adhered on the upper surface of a turn table 4 by an air cylinder 3. On the other hand, to the turn table 4, the rotational motion is also given by a turn table driving motor 6. Accordingly, a relative motion occurs between the wafer 1 and the polishing pad 9. The wafer 1 is polished by supplying polishing slurry 7 to a surface of the polishing pad 9 while giving the relative motion between the wafer 1 and the polishing pad 9. For the polishing slurry in the case, abrasive grains of colloidal silica dispersed in alkali aqueous solution is used, so that the wafer 1 is polished by the so-called mechano-chemical function which compounds a mechanical function and a chemical function.

In the mechano-chemical function, the speed of removing the wafer material, for example, silicon is proportional to the force that the wafer 1 vertically presses the polishing pad 9, that is, the polishing pressure. As a result, when the polishing pressure is non-uniformly distributed within the wafer 1, the removal amount of the material is not uniform within the wafer 1, so that the wafer 1 is not flatly polished. Therefore, in order to obtain the flat wafer 1, it is important to make the distribution of the polishing pressure uniform within the wafer 1.

However, the polishing pad 9 has a visco-elastic property to cause creep deformation. That is, when the constant load is continuously applied to the polishing pad 9, the polishing pad 9 is pressed to be thinned. The amount of the reduced thickness, that is, the amount of displacement is increased rapidly right after applying the load and is increased slowly thereafter. Then, the thickness of the polishing pad 9 does not return to the thickness before the load was applied even if the load is removed, so that the displacement will remain forever. Accordingly, under the constant load, the amount of the displacement of the polishing pad 9 greatly depends on the time during which the polishing pad 9 is subjected to the load.

FIG. 5 shows the relation between the distance from the center 60 of the turn table 4 and the applied time of the polishing load which is applied to the polishing pad 9 in an automatic single wafer polishing machine which polishes the wafer 1. According to FIG. 5, it is understood that the applied time of the polishing load is not uniform according to the position on the polishing pad 9. The problem of non-uniformity of the applied time of the polishing load also occurs when the position of the wafer from the center of the turn table varies in the automatic single wafer polishing machine and in the batch processing polishing machine wherein many wafers are held to adhere on a holding plate.

When the applied time of the polishing load is not uniform according to the position on the polishing pad 9, the amount of displacement of the polishing pad 9 depends on the load application time as above-described, so that the amount of displacement of the polishing pad 9 which is adhered to the turn table 4 is not uniform. The thickness of a polishing pad which was used actually has been measured. As a result, a difference in the amount of displacement of about 50 $\mu$m is observed between a portion to which the load was most applied and a portion to which no load was applied.

For the purpose of removing harmful influence on the flatness of the wafer, especially waviness and ripple, and avoiding the influence of the visco-elastic property of the polishing pad, especially, the creep deformation which rapidly progresses right after the polishing pad is used, a treatment of the polishing pad, of which a method is similar to the polishing method of the wafer is carried out.

For the treatment, a polishing machine which is used for polishing the wafer, that is, for manufacturing the wafer is used. The time when the treatment is carried out is right after that a new polishing pad is adhered to the turn table. For tools which are used instead of the wafer are a ceramic disc on which grooves are formed, and a quartz or a silicon disc which is adhered on the surface of the holding plate which is used for actual polishing of the wafer.

However, if the polishing machine which is used for manufacturing the wafer is also used for the treatment of the polishing pad, there is a problem that the manufacturing of the wafer is required to be stopped during the treatment of the polishing pad. For the treatment of the polishing pad, it is required to suitably select the temperature of the polishing pad, the load applied to the polishing pad or the like. However, there is a problem that it is not possible to suitably select the operating conditions except the polishing time in the polishing machine. Further, there is a problem that it is always required to prepare the tools for the treatment of the polishing pad.

SUMMARY OF THE INVENTION

The present invention was developed in view of the above-described problems. Therefore, an object of the present invention is to provide a polishing pad, a method and an apparatus for treating a polishing pad; wherein the polishing pad has small creep deformation. high flatness and small surf ace roughness; and it is not required to stop a polishing operation during a treatment of the polishing pad. Another object of the present invention is to provide a polishing method from which a wafer having high flatness can be obtained.

In order to accomplish the above-described object, in one aspect of the present invention, a polishing pad for pressing a work to be polished to a surface thereof, comprises a structure obtained by being compressed under a temperature which is higher than an operating temperature for polishing the work and/or under a pressure which is equal or higher than an operating pressure for polishing the work. The polishing pad can cause little creep deformation during the polishing of the work, because the polishing pad is compressed under the above-described condition. The work can be a wafer or the like. Therefore, it is possible to obtain a high flatness wafer by using the polishing pad.

The operating temperature of the polishing pad is 15–50° C. and the operating pressure thereof is 50–1000 g/cm$^2$, for example. The temperature can be freely selected relatively, however, it may be preferable that the temperature is within such a range that the deformation progresses quickly and the chemical property of the polishing pad does not deteriorate. The polishing pad can have a foamed structure. The foamed structure can be continuous or independent. It may be preferable that the pressure is within such a range that a basic structure of the polishing pad is not destroyed, that is, the foamed structure is not crushed to disappear.

A plurality of grooves can be formed in a surface of the polishing pad. The forms of the grooves can be various as far as polishing slurry can be spread over the surface of the polishing pad and easily discharged, during the polishing of the work.

In accordance with another aspect of the present invention, a method for treating a polishing pad to be adhered to a turn table, for pressing a work to be polished to a surface of the polishing pad, comprises the step of: compressing the polishing pad under a temperature which is higher than an operating temperature for polishing the work and/or under a pressure which is equal to or higher than an operating pressure for polishing the work.

According to the method of the present invention, because the polishing pad is compressed under the temperature which is higher than the operating temperature for polishing the work and/or under the pressure which is equal to or higher than the operating pressure for polishing the work, the visco-elastic property of the polishing pad is changed. Therefore, because a deformation which rapidly progresses right after applying a load is progressed as large as possible, it is possible to obtain a polishing pad having small creep deformation, high flatness, and small surface roughness.

The compressing step can be carried out before adhering the polishing pad on the turn table and the polishing pad can have a foamed structure. The temperature, the pressure, and the structure of the polishing pad are the same condition as that above-described. Because the compressing step can be carried out before adhering the polishing pad on the turn table, the polishing pad can cause little creep deformation during a polishing process.

The method can further comprise the steps of: holding the polishing pad between two plate-like members to compress the polishing pad and applying a fluid pressure to an outer surface of at least one of the plate-like members. It may be preferable that the plate-like members are thin and easy to bend, such as thin plate of stainless steel to uniformly compress the polishing pad. However it is not limited to this, so that another type of the plate-like member can be used. According to the method, because the fluid pressure can be used, it can be possible to apply the uniform pressure to the polishing pad and to obtain the polishing pad having high flatness and small surface roughness.

The method can further comprise the steps of: disposing a hermetic seal member between the two plate-like members to have a hermetic space in which the polishing pad is disposed; and reducing a pressure of the space to draw the plate-like members closer to each other. For the hermetic seal member, it can be used various materials through which the gas can not pass.

The method can further comprise the steps of: forming irregularities in an inner surface of one of the plate-like members; and transferring the irregularities to a surface of the polishing pad. The irregularities formed on the plate-like member can be projections to form grooves in the surface of the polishing pad. According to the method of the present invention, because the grooves can be formed in the surface of the polishing pad, it can be possible to obtain the polishing pad which can spread the polishing slurry over the surface of the polishing pad and easily discharge the polishing slurry.

In accordance with another aspect of the present invention, an apparatus for treating a polishing pad for pressing a work to be polished to a surface of the polishing pad, the apparatus comprises: two plate-like members to hold the polishing pad between them to compress the polishing pad. The two plate-like members can compress the polishing pad by being applied a fluid pressure to an outer surface of at least one of the plate-like members.

The polishing pad and the plate-like members can be the same type as that above-described.

The apparatus can further comprise a hermetic seal member between the two plate-like members to have a space among the two plate-like members and the hermetic seal member, wherein the two plate-like members compress the polishing pad disposed in the space by drawing the plate-like members to each other by reducing a pressure of the space.

According to the apparatus of the present invention, because the two plate-like members can compress the polishing pad by being applied the fluid pressure or reducing the pressure of the space where the polishing pad is disposed, the polishing pad is applied an uniform pressure. Therefore, it can be possible to obtain the polishing pad having small creep deformation, high flatness, and small surface roughness.

With the apparatus, one of the plate-like members can comprise a structure having irregularities formed in an inner surface thereof and the irregularities can be transferred to a surface of the polishing pad. According to the apparatus of the present invention, it can be possible to obtain the polishing pad which can spread the polishing slurry over the surface of the polishing pad and easily discharge the polishing slurry, during the polishing of the work.

With the apparatus, the two plate-like members and the hermetic seal member, for compressing the polishing pad can be contained in a thermostatic chamber.

In accordance with a further aspect of the present invention, a method for polishing a work, comprises the step of polishing the work by using a polishing pad comprising a structure obtained by being compressed under a temperature which is higher than an operating temperature for polishing the work and/or under a pressure which is equal to or higher than an operating pressure for polishing the work. The polishing pad can cause little creep deformation during the work is polished.

According to the method of the present invention, because the work, for example, a wafer is polished by the polishing pad having small creep deformation, high flatness, and small surface roughness, it is possible to obtain the wafer having high flatness.

In the method, the polishing pad can have a plurality of grooves in a surface thereof, which is a side contacting with the work during the polishing of the work. According to the method, because the polishing pad can have the grooves on a surface thereof, it can be possible to spread the polishing slurry over the surface of the polishing pad and easily discharge the polishing slurry, during polishing of the work.

As above-described, according to the present invention, it is possible to obtain a polishing pad having small creep deformation, high flatness, and small surface roughness. Accordingly, it is possible to obtain a flat wafer. Further, the treatment is carried out by an apparatus which is different from a polishing machine, so that it is possible to rationalize operations without stopping manufacturing of a wafer.

BRIEF DESCRIPTION OF THE DRAWINGS

The above and other objects, features and advantages of the invention will become more apparent from the following description taken in conjunction with the accompanying drawings wherein like references refer to like parts and wherein:

FIGS. 3A and 3B are graphical representations showing results of measuring a thickness of a polishing pad according to an embodiment of the present invention; wherein FIG. 3A shows results of not carrying out a method for treating a polishing pad according to an embodiment of the present invention, FIG. 3B shows results of carrying out the method;

PROFFERED EMBODIMENT OF THE INVENTION

Figure 1:
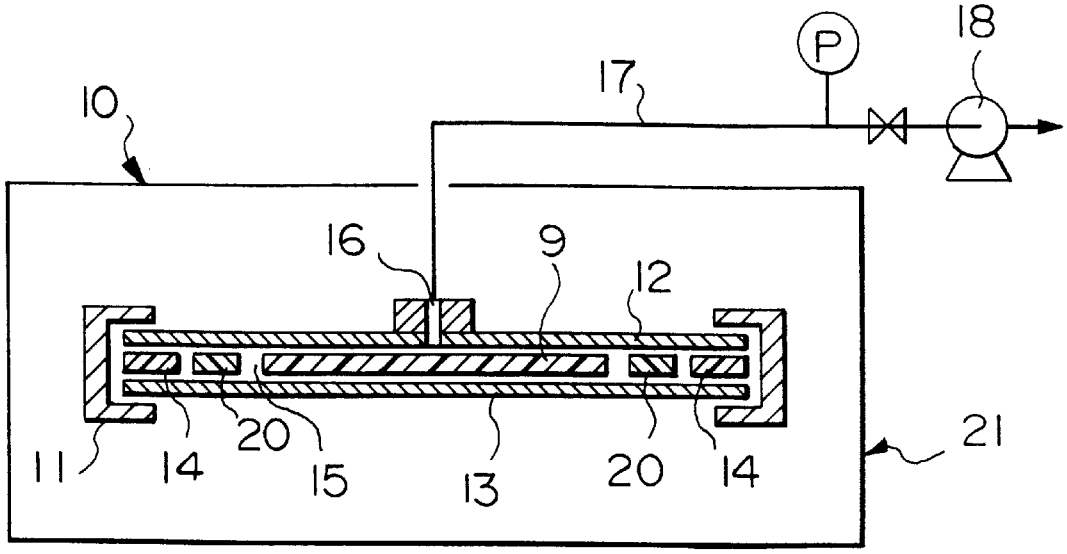
FIG. 1 is a schematic illustration of an apparatus for treating a polishing pad according to the first embodiment of the present invention.

As above-described, the polishing pad has visco-elastic property, so that the deformation thereof rapidly progresses right after applying the load, then the deformation slowly progresses thereafter. The higher the temperature is and the larger the load is, the higher the speed of the deformation becomes. There is a difference in the visco-elastic property of the polishing pads between the one which was treated by being applied with the high temperature and the large load and the other which was treated by being not applied by them. That is, the amount of deformation of the former is smaller than that of the latter when the applied load is the same.

The present invention uses this phenomenon. In the present invention, the polishing pad is left for hours under such environmental circumstances, a temperature and/or a pressure of which are higher than that which the polishing pad is subjected to during polishing of a work, that is, an operating temperature and a pressure of the polishing pad so that the visco-elastic property of the polishing pad may change. The polishing pad can also be left for hours under such environmental circumstances, a pressure of which is equal to the operating pressure; or a temperature of which is higher than the operating temperature and a pressure of which is equal to the operating pressure. That is, in the present invention, the deformation which rapidly progresses right after applying the load is progressed as large as possible.

The operating temperature of the polishing pad is 15–50° C. and the operating pressure thereof is 50–1000 g/cm$^2$, for example. In the present invention, the temperature under which the polishing pad is left can be freely selected relatively, however, it may be preferable that the temperature is within such a range that the deformation progresses quickly and the chemical property of the polishing pad does not deteriorate. It may be preferable that the pressure and the time of the treatment in the present invention are within such a range that a basic structure of the polishing pad is not destroyed. That is, these are within such a range that the foamed structure is not crushed to disappear, when the polishing pad is made of an unwoven cloth having a continuous foamed structure or an independent foamed structure. It may be preferable that the treatment for compressing the polishing pad is performed before the polishing pad is adhered to the turn table of the polishing machine.

Next, the polishing pad to be treated is explained as follows. For the polishing pad which is used in the first and the second polishing steps, a polyester unwoven cloth impregnated with polyurethane, having the continuous foamed structure, that is, the spaces between fibers are continuous, which is called a velour type, is used. For the polishing pad which is used in the third polishing step which is for the final polishing, a polyester unwoven cloth, on a surface of which the independent foamed layers of polyurethane are layered, which is called a suede type, is used.

It is preferable to apply the fluid pressure for compressing the polishing pad with the apparatus for treating the polishing pad. This is for applying the uniform pressure to the polishing pad. It is preferable that the plate-like member for compressing the polishing pad is thin and easy to bend so that the polishing pad may be uniformly compressed. Further, when the polishing pads are layered through the plate-like members, it is possible to treat a plurality of polishing pads at the same time.

For a polishing pad, the polyester unwoven cloth is impregnated with the polyurethane to have the continuous foamed structure, thereafter, sliced to a predefined thickness, and ground to have a smooth surface and a thickness of 1270 $\mu$m, which is marketed by Rodel, Inc. by name of "SUBA- 600" is used. This polishing pad is applied to the first polishing step for polishing a silicon wafer.

For a treating apparatus for the polishing pad, the apparatus shown in FIG. 1 is used according to the first embodiment of the present invention. The treating apparatus 10 for the polishing pad comprises a machine casing 11, two compressing plates 12 and 13 in the machine casing 11, which are thin plates of stainless steel having a thickness of 0.3 mm, and a soft sealing material 14 as a hermetic seal member between peripheral portions of the compressing plates 12 and 13 to make a space 15. An opening portion 16 which leads to the space 15 is formed through the compressing plate 12 and connected to an oil rotary vacuum pump 18 through a hose 17. In the space 15, the polishing pad 9 is disposed. In the space 15, a spacer 20 which is slightly thinner than the polishing pad 9 is disposed around the polishing pad 9. With the treating apparatus 10 for the polishing pad, the machine casing 11, the compressing plates 12 and 13 or the like, which constitute a compressing means are contained in a thermostatic chamber 21.

The treatment for the polishing pad by applying the treating apparatus 10 for the polishing pad was carried out through the following procedures. The polishing pad 9 was disposed in the space 15 of the treating apparatus 10 for the polishing pad. Thereafter, the compressing means was contained in the thermostatic chamber 21 which had been heated to 120° C. in advance, then, the oil rotary vacuum pump 18 was driven. The heat capacity of the compressing means of the treating apparatus 10 for polishing pad is small and the space volume thereof is also small, so that after several minutes, the temperature and the pressure of the compressing means reached 120° C. and −1000 g/cm$^2$, respectively. Then, it was left for 4 hours with this condition. Therefore, both surfaces of the polishing pad 9 are applied the load of 1000 g/cm$^2$ at 120° C. for 4 hours with contacting to the compressing plates 12 and 13.

It was also carried out the treatment which will be described as follows. On a surface of the compressing plate, to which one surface of the polishing pad 9 is contacted, projecting portions having a height of 0.5 mm and width of 1 mm were formed at intervals of 15 mm. Then, the same treatment for the polishing pad as above-described was carried out by using the compressing plate. The purposes of forming the projecting portions are to form grooves on the surface of the polishing pad 9, to spread the polishing slurry entirely over the surface of the polishing pad by the grooves and to easily discharge the polishing slurry, during the polishing process.

The effect on the visco-elastic property of the polishing pad 9 by the present invention was evaluated through the following procedures.

(1) Initial thickness of the polishing pad 9 was measured.

(2) After the polishing pad 9 was treated by the treating apparatus 10 for the polishing pad, the thickness of the polishing pad 9 was measured.

(3) A simulated load was applied to the polishing pad 9 for hours continuously. The simulated load corresponds to a load which is applied to the polishing pad 9 during the polishing of the wafer; the polishing pad 9 is adhered to the turn table of the polishing machine. Concretely, a static load of 1000 g/cm$^2$ was continuously applied to the polishing pad 9 for 15 hours. Then, the thickness of the polishing pad was measured right after removing the simulated load.

(4) The polishing pad 9 was left at room temperature with being applied no load for 7.5 hours, then, the thickness of the polishing pad 9 was measured.

In each process, the thickness of the polishing pad 9 was measured by a dial gauge after thirty seconds of applying a static load of 0, 200, 400, 600, 800, and 1000 g/cm$^2$, respectively.

Figure 3A:
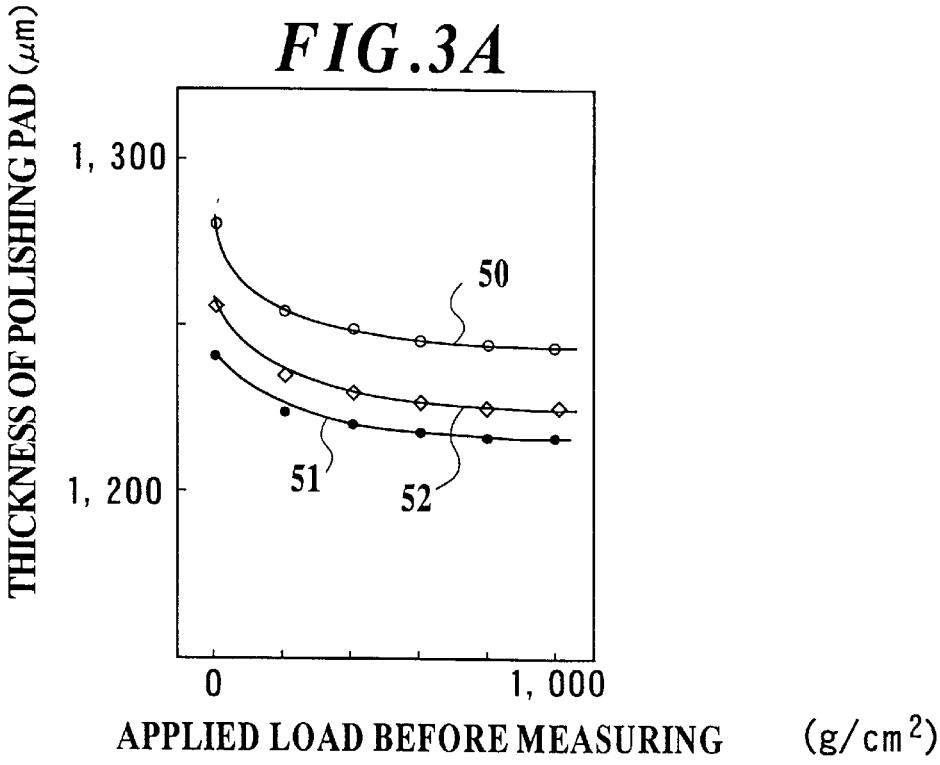
Figure 3B:
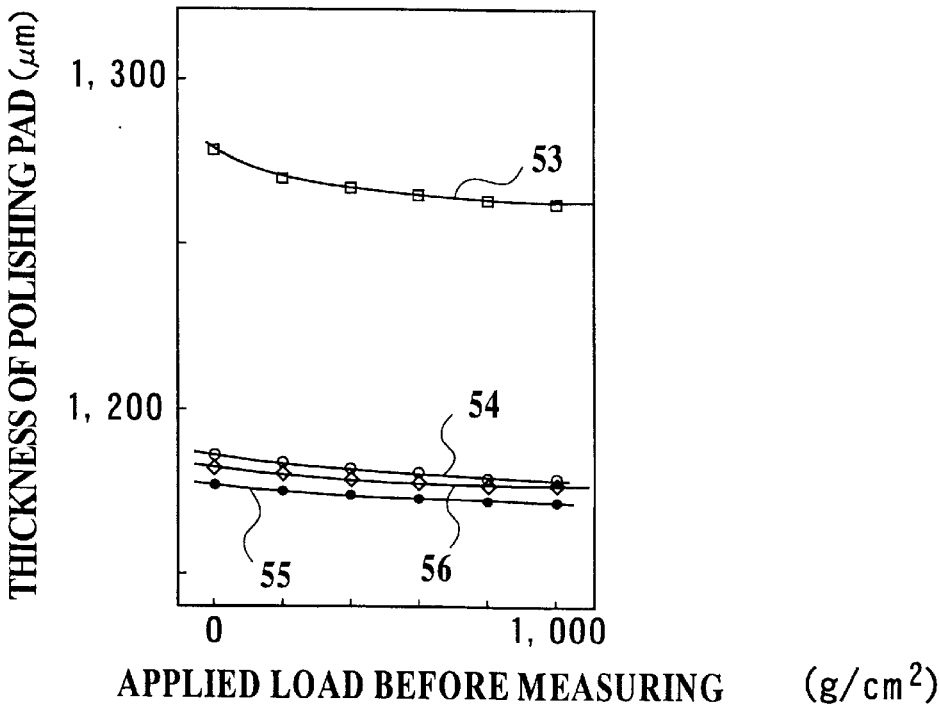

The result is shown in FIG. 3B. FIG. 3B shows the thickness 53 of the polishing pad 9 before the treatment, the thickness 54 thereof before the simulated load is applied, the thickness 55 thereof after the simulated load is applied, and the thickness 56 thereof after the polishing pad is left for 7.5 hours. The case that the static load was 1000 g/cm$^2$ will be explained as follows. The polishing pad 9 having an initial thickness of 1270 $\mu$m was compressed by 80 $\mu$m which was a reduced amount of thickness by the process (2). The polishing pad 9 was further compressed by 8 $\mu$m by the process (3). The thickness of the polishing pad 9 was recovered by 5 $\mu$m by the process (4), then, the creep deformation of 3 $\mu$m which was the difference between them was remained.

On the other hand, the result in the case that the process (2) was omitted is shown in FIG. 3A. FIG. 3A shows the thickness 50 of the polishing pad 9 before the simulated load is applied, the thickness 51 thereof after the simulated load is applied, and the thickness 52 thereof after the polishing pad is left for 7.5 hours. When the static load before measuring was 1000 g/cm$^2$, the polishing pad 9 was compressed by 28 $\mu$m by the process (3), the thickness of the polishing pad 9 was recovered by 8 $\mu$m by the process (4), then, the creep deformation of 20 $\mu$m which the difference between them was remained.

Accordingly, when the process (2) of the present invention is carried out, the creep deformation of the polishing pad 9 is much smaller compared to that when the process (2) of the present invention is not carried out, so that the effect of the process (2) is clear. Therefore, the polishing pad causes little deformation during the polishing of the wafer. The surface and the cross section, of the polishing pad 9 were observed by an electron microscope before and after the treatment. As a result, it was found that the flatness of the flat surface was improved externally. Further, the surface roughness, that is, a center line average roughness was also improved from Ra=14 $\mu$m to Ra=10 $\mu$m. When the compressing plate, on the surface of which the projecting portions were formed, was used, the grooves were formed on the surface of the polishing pad 9.

Figure 2:
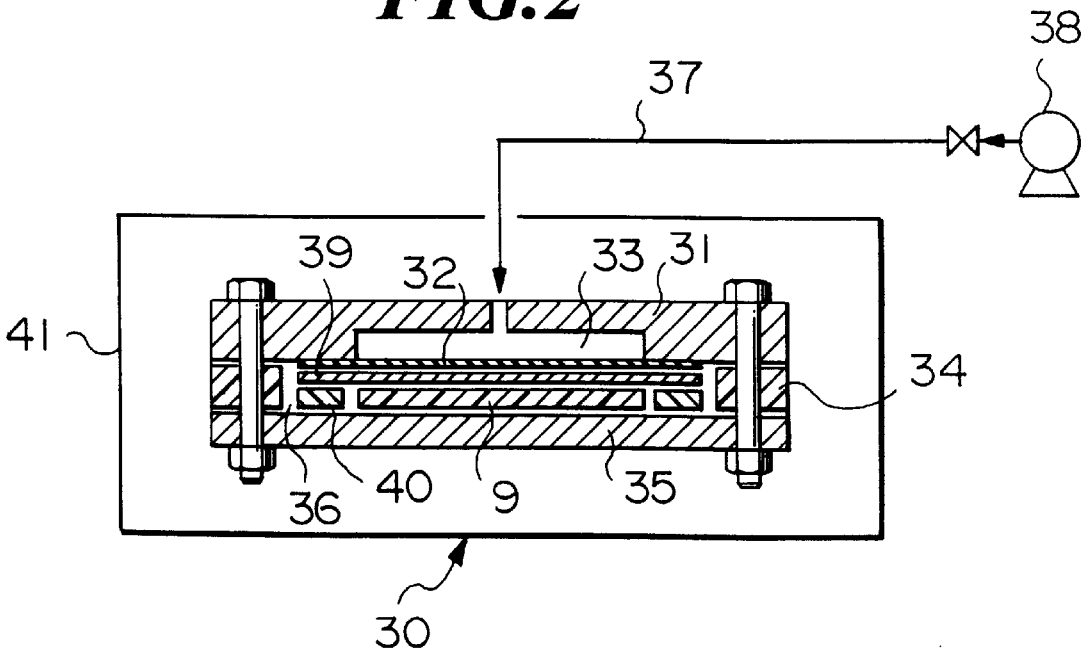
FIG. 2 is a schematic illustration of an apparatus for treating a polishing pad according to the second embodiment of the present invention.

FIG. 2 shows a treating apparatus 30 for a polishing pad according to the second embodiment of the present invention, which is different from the treating apparatus 10 for the polishing pad, which is used in the first embodiment.

With the treating apparatus 30 for the polishing pad, a recess portion is formed in an inner surface of a plate-like apparatus body 31. A rubber sheet 32 is adhered to the apparatus body 31 to cover the recess portion, so that a pressurizing chamber 33 is formed. A lower compressing plate 35 is disposed under the apparatus body 31 and a spacer 34 is disposed between the peripheral portion of the lower compressing plate 35 and the apparatus body 31, so that a space 36 is formed. The pressurizing chamber 33 is connected to a vacuum pump 38 through a hose 37. In the space 36, the polishing pad 9 is disposed on the lower compressing plate 35 and an upper compressing plate 39 is disposed on the polishing pad 9. A spacer 40 which is thinner than the polishing pad 9 is disposed around the polishing pad 9.

The compressing means, such as the compressing plates 35 and 39, the apparatus body 31 or the like, of the treating apparatus 30 for the polishing pad is contained in a thermostatic chamber 41. The vacuum pump 38 is driven under the condition of a constant temperature. Then, the fluid is applied into the pressurizing chamber 33, so that the rubber sheet 32 is inflated downwardly. Accordingly, the upper compressing plate 39 is moved downwardly, so that the polishing pad 9 is compressed between the upper compressing plate 39 and the lower compressing plate 35. Accordingly, it is possible to obtain the same advantageous effect as that of the first embodiment of the present invention.

In the above-described embodiments, the polishing pad 9 was subjected to the load of 1000 g/cm$^2$ at 120° C. for 4 hours. However, it was possible to obtain the similar effect when the polishing pad 9 was subjected to the load of 500–2000 g/cm$^2$ at 80–100° C. for 1–10 hours. In these cases, the surface roughness, that is, the center line average roughness was also improved from Ra=14 $\mu$m to Ra=5–10 $\mu$m.

In the two above-described embodiments, it is described the case that only one polishing pad is treated, however, by increasing the number of the compressing plates, it is possible to easily treat a plurality of polishing pads.

Figure 4:
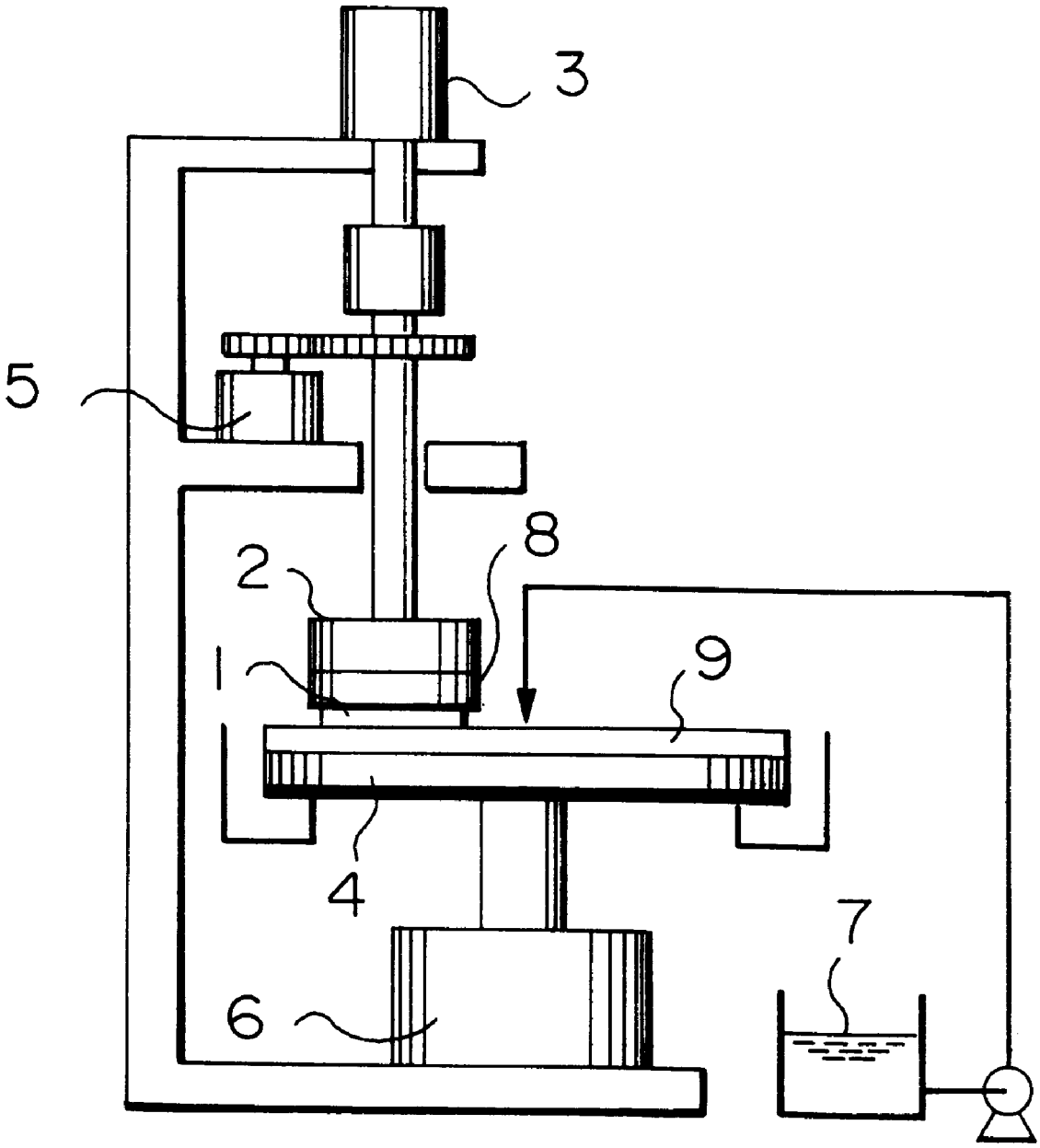
FIG. 4 is a schematic illustration of a polishing machine which is generally used in a process of polishing a wafer.
Figure 5:
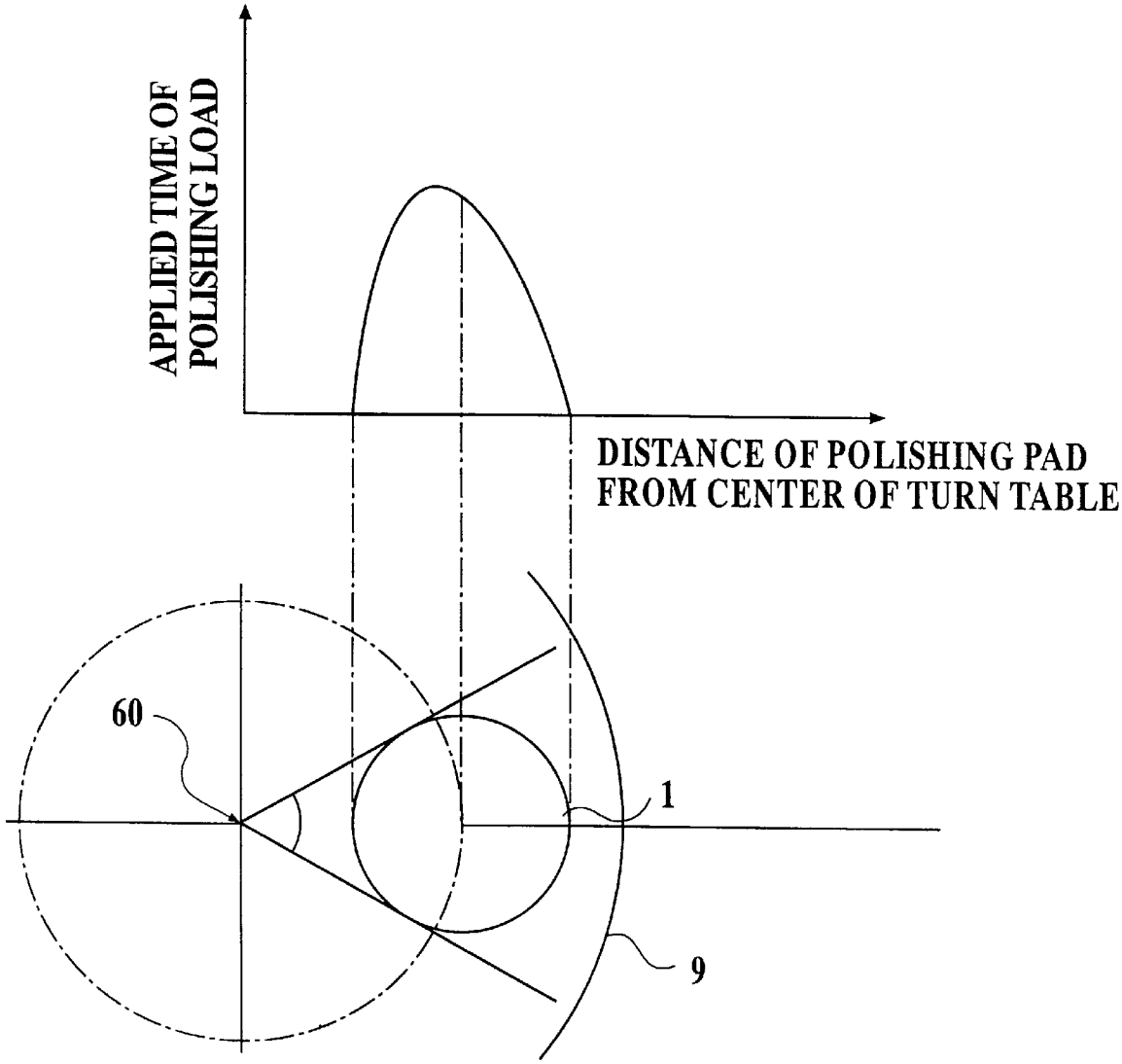
FIG. 5 is a view showing applied time of the polishing load on each portion of the polishing pad.

Then, a wafer is polished with the polishing machine, for example, the one shown in FIG. 4 by using the polishing pad obtained by the above-described treatments. During the polishing process, little creep deformation of the polishing pad causes. When the polishing pad having grooves on the surface thereof is used for the polishing process, the polishing slurry is spread over the surface of the polishing pad and easily discharged, during the polishing process. The wafer obtained by the polishing process has high flatness.

According to the method for polishing a wafer, because the polishing pad has small creep deformation, high flatness, and small surface roughness, it is possible to obtain a wafer having high flatness.

From the foregoing description, one skilled in the art can easily ascertain the essential characteristics of this invention, and without departing from the spirit and scope thereof, can make various changes and modifications of the invention to adapt it to various usage and conditions.

The entire disclosure of Japanese Patent Application No. 10-74696 filed on Mar. 23, 1998 including specification, claims, drawings and summary are incorporated herein by reference in its entirety.

What is claimed is:

1. A polishing pad for pressing a work to be polished to a surface of the polishing pad, wherein:

the polishing pad comprising unwoven cloth impregnated with polyurethane and having a continuous foamed structure in which spaces between fibers are continuous, and the polishing pad having a compressed structure obtained by compressing the polishing pad under one of the following conditions: (a) a temperature that is higher than an operating temperature for polishing the work, (b) a pressure that is equal to an operating pressure for polishing the work, or (c) a pressure that is higher than the operating pressure for polishing the work.

2. The polishing pad as claimed in claim 1, wherein the polishing pad has reduced creep deformation.

3. The polishing pad as claimed in claim 1, comprising a plurality of grooves formed in a surface of the polishing pad for spreading polishing slurry over the surface of the polishing pad and for enhancing the discharging of the polishing slurry from the polishing pad.

4. The polishing pad as claimed in claim 1, wherein the polishing pad consists essentially of unwoven cloth impregnated with polyurethane and has a continuous foamed structure in which spaces between fibers are continuous.

5. A method for treating a polishing pad to be adhered to a turn table, for pressing a work to be polished to a surface of the polishing pad, the method comprising:

compressing the polishing pad under one of the following conditions: (a) a temperature that is higher than an operating temperature for polishing the work, (b) a pressure that is equal to an operating pressure for polishing the work, or (c) a pressure that is higher than the operating pressure for polishing the work, wherein the polishing pad comprising unwoven cloth impregnated with polyurethane and having a continuous foamed structure in which spaces between fibers are continuous.

6. The method as claimed in claim 5, wherein the compressing step is carried out before adhering the polishing pad on the turn table.

7. The method as claimed in claim 5, further comprising a step of holding the polishing pad between two plate-like members to compress the polishing pad by applying a pressure to the polishing pad.

8. The method as claimed in claim 5, wherein the polishing pad consists essentially of unwoven cloth impregnated with polyurethane and has a continuous foamed structure in which spaces between fibers are continuous.

9. The method as claimed in claim 7, further comprising a step of applying a fluid pressure to an outer surface of at least one of the plate-like members to compress the polishing pad.

10. The method as claimed in claim 7, further comprising the steps of:

disposing a hermetic seal member between the two plate-like members to form a hermetic space in which the polishing pad is disposed; and reducing a pressure of the space to draw the plate-like members closer to each other.

11. The method as claimed in claim 7, further comprising the steps of:

forming irregularities in an inner surface of one of the two plate-like members; and transferring the irregularities to a surface of the polishing pad.

12. The method as claimed in claim 11, wherein the irregularities formed on the plate-like member are projections that form grooves in the surface of the polishing pad, the grooves spreading polishing slurry over the surface of the polishing pad and enhancing the discharging of the polishing slurry from the polishing pad.

13. A method for polishing a work, comprising:

compressing a polishing pad under a condition selected from the group consisting of (a) a temperature that is higher than an operating temperature for polishing the work, (b) a pressure that is equal to or higher than an operating pressure for polishing the work, and (c) a temperature that is higher than the operating temperature for polishing the work and a pressure that is equal to or greater than the operating pressure for polishing the work, wherein the polishing pad comprising unwoven cloth impregnated with polyurethane and having a continuous foamed structure in which spaces between fibers are continuous;

adhering the polishing pad on a turn table; and polishing the work with the polishing pad.

14. The method as claimed in claim 13, wherein the polishing pad causes little creep deformation of the work during the polishing.

15. The method as claimed in claim 13, wherein the polishing pad includes a plurality of grooves in a surface of the polishing pad, the surface being on a side of the polishing pad contacting with the work during the polishing of the work, the grooves spreading polishing slurry over the surface of the polishing pad and enhancing the discharging of the polishing slurry during the polishing of the work.

16. The method as claimed in claim 13, wherein the polishing pad consists essentially of unwoven cloth impregnated with polyurethane and has a continuous foamed structure in which spaces between fibers are continuous.

17. The polishing pad as claimed in claim 1, comprising a structure having a thickness difference of not more than 3 $\mu$m between (a) a first thickness immediately after a static load of 1000 g/cm$^2$ was applied to the polishing pad for 15 hours, and (b) a second thickness after the polishing pad to which the static load of 1000 g/cm$^2$ was applied for 15 hours then is subjected to no applied load for 7.5 hours.

18. The polishing pad as claimed in claim 17, comprising a plurality of grooves formed in a surface of the polishing pad for spreading polishing slurry over the surface of the polishing pad and for enhancing the discharging of the polishing slurry from the polishing pad.

19. The method as claimed in claim 13, comprising preparing the polishing pad such that the polishing pad comprises a structure having a thickness difference of not more than 3 $\mu$m between (a) a first thickness immediately after a static load of 1000 g/cm$^2$ was applied to the polishing pad for 15 hours, and (b) a second thickness after the polishing pad to which the static load of 1000 g/cm$^2$ was applied for 15 hours then is subjected to no applied load for 7.5 hours.

* * * * *